United States Patent [19]

DeLaro

[11] Patent Number: 4,784,626

[45] Date of Patent: Nov. 15, 1988

[54] SUNKEN VESSEL LOCATOR BUOY

[76] Inventor: Paul J. DeLaro, Rte. 2, Box 228-X, Freeport, Tex. 77541

[21] Appl. No.: 48,644

[22] Filed: May 11, 1987

[51] Int. Cl.[4] ..... B63B 22/08

[52] U.S. Cl. ..... 441/7

[58] Field of Search ..... 441/6, 7, 11, 16, 23–28

[56] References Cited

U.S. PATENT DOCUMENTS

| | | | |
|---|---|---|---|
| 1,070,253 | 8/1913 | Hebert | 441/7 |
| 1,566,934 | 12/1925 | Tomic | 441/7 |
| 1,615,108 | 1/1927 | Clyde | 441/7 |
| 3,225,368 | 12/1965 | Allen | 441/7 |
| 3,465,987 | 9/1969 | Harmon et al. | 441/23 |
| 3,981,036 | 9/1976 | Higgs | 441/7 |

*Primary Examiner*—Joseph F. Peters, Jr.
*Assistant Examiner*—Jesus D. Sotelo

[57] ABSTRACT

An improved buoy which provides for internal storage of the line securing the buoy to the vessel, internal placement of a radio transmitter with power source and electrical switch, and a receptacle for attachment to the superstructure of a vessel.

4 Claims, 4 Drawing Sheets

SUNKEN VESSEL LOCATOR BUOY

BACKGROUND OF THE INVENTION

1. Field of the Invention

This invention relates to new and improved buoys for indicating the position of a sunken vessel and more particularly to said buoys as are normally resident in a receptacle which is attached to the superstructure or upper decks of a vessel, which is designed to be released upon submersion of the vessel, and which is useful in locating the vessel after it has sunk.

2. Description of the Prior Art

It is well known in the art of buoys to place a buoy in a receptacle on the upper deck of a vessel, attached to the vessel by a line, so that it will float free of the vessel and, subsequently floating on the surface of the water, mark the location of the vessel after it has sunk.

It is additionally known in the art of buoys to place both a buoy and the line connecting the buoy to the vessel in a housing or receptacle on an upper deck of the vessel to float free of the vessel, in case of the vessel's sinking.

It is further known in the art of buoys to provide a buoy which is and/or supports a visual indicator on the surface of the water above a sunken vessel of the vessel's position.

It is also well known to provide a drum or winding mechanism to contain the line and/or control the feed of the line connecting the buoy to the vessel.

The following patents indicate the state of the art in buoys designed to indicate the position of a sunken vessel.

A. J. Hebert, U.S. Pat. No. 1,070,253 discloses a buoy with a support which contains the buoy's connecting line to the vessel, mounts on a topside deck of the vessel, and provides spring retaining arms to retain the buoy in place within the support.

E. H. W. Crossley, U.S. Pat. No. 1,250,807 discloses a buoy in combination with a spring loaded means for mounting said buoy which acts to project the buoy clear of the vessel in the event of submersion or assumption of a dangerous angle.

J. Hlvaty, Jr., U.S. Pat. No. 1,352,000 discloses a buoy in combination with a drum upon which the line connecting the buoy to the vessel is wound and a casing having a plurality of compartments, one of which compartments normally contains the buoy and provides a pair of spring-impelled lever arms adapted to hold the buoy in position until such time as the rising water level in another of the compartments causes a float therein to rise and trip a lever disengaging the spring-impelled lever arms holding the buoy whereby the buoy is allowed to float free.

J. J. Higgins, U.S. Pat. No. 1,517,158 discloses a can buoy with receptacle, which buoy supports a visual indicating signal which is held in an upright position irrespective of the wave action on the buoy. The receptacle provides storage for the line and/or chain connecting the buoy to the vessel, is designed to be attached to the vessel's upper deck, and allows the buoy to float free when the vessel sinks.

H. Tomic, U.S. Pat. No. 1,566,934 discloses a buoy and buoy anchorage housing with means for locking the buoy on the housing. The housing provides an annular seat for the spherical buoy and the buoy has a cylinder which extends up into the buoy which cylinder is open at the bottom end. Additional means are provided to, moveably within the cylinder, release the locking means when the water rises into the cylinder of the buoy.

S. V. Clyde, U.S. Pat. No. 1,615,108 discloses a buoy, a drum to hold the line connecting the buoy to the vessel, and a support for the buoy which, when holding the buoy, is positioned directly above the drum, but when the buoy floats free swings clear of the drum to avoid entangling the line.

L. H. Roeth, U.S. Pat. No. 1,839,001 discloses a buoy which sits atop a funnel pipe which extends to the bottom of the vessel where a drum sits with line coiled, which line connects the buoy through the funnel pipe to the bottom of the vessel. The drum provides means for controlling the pay out of the line such that the drum rotates and line is paid out only during those times when the buoy is submerged.

B. W. Allen, U.S. Pat. No. 3,225,368 discloses a buoy which is cored and normally rests on a spindle which is part of a buoy holder having resilient and flexible fingers from which the buoy floats free upon submersion in water. The line connecting the buoy to the vessel is wound upon either a portion of the spindle beneath the buoy or a separate drum.

SUMMARY OF THE INVENTION

The primary object of the invention is to provide a low-cost, reliable buoy with radio beacon that will serve to locate sunken vessels.

It is another object of the invention to provide a buoy with storage space internal to the buoy for the line connecting the buoy to the vessel.

It is yet another object of the invention to provide a buoy with a line guide integral to the buoy to avoid line fouling.

It is stil another object of the invention to provide a buoy having compartments suitable for the placement of a radio transmitter, a battery or power source, and a radio transmitter antenna.

It is further an object of the invention to provide a receptacle suitable for storage of the buoy when not in use and suitable, further, for reliable buoy flotation should the vessel to which the buoy is attached become submerged.

It is finally an object of the invention to provide a buoy which may be opened for servicing of the battery, radio transmitter, or line and which may be easily restored to a watertight condition.

These and other objects are accomplished as described in the accompanying drawings and the following description of the invention.

DESCRIPTION OF THE INVENTION

Figure 1:
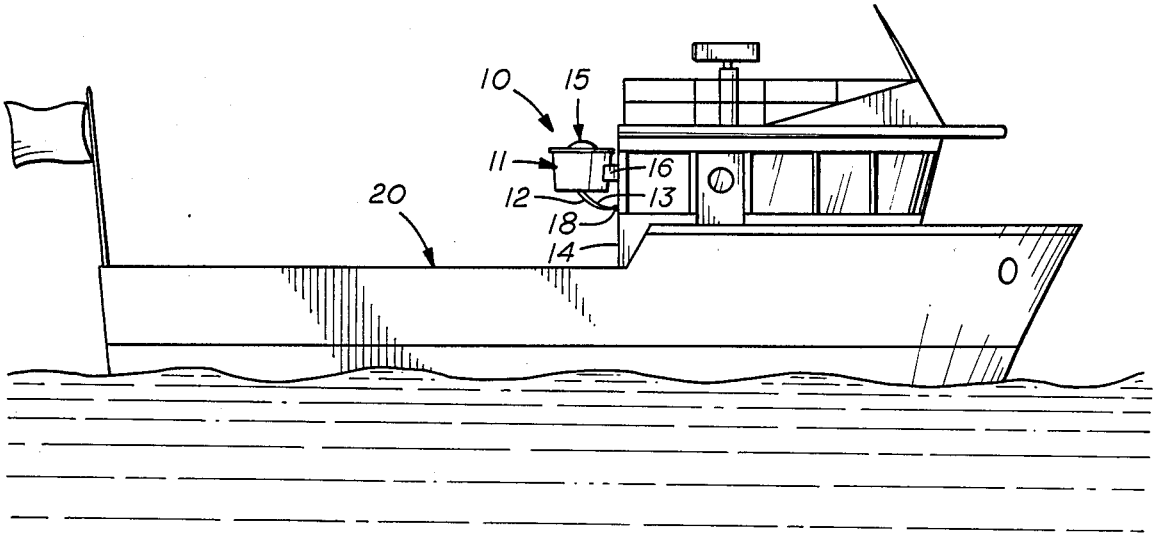
FIG. 1 is a schematic lateral view showing the invention installed on the superstructure of a vessel.

Referring in detail to the drawings, the invention 10 is shown in FIG. 1 as attached to the superstructure 14 of the vessel 20. The invention 10 is shown only in an external view in FIG. 1 where the invention 10 may be seen to comprise a buoy 15 inside a receptacle 11, which receptacle 11 provides a mounting bracket 16 for attachment of the invention 10 to the superstructure 14 with fastener means 17. Additionally, the receptacle 11 provides an orifice 13 through which pass a line 12 and a pull-key chord 19. The line 12 attached to the buoy 15 on one end and attaches to the superstructure 14 on the other end by means of the fastener means 18. The pull-key chord 19 attaches to a pull-key shaft 41 within the buoy 15 on one end and attaches to the superstructure 14 on the other end by means of the fastener means 18 as shown in FIG. 1.

Figure 2:
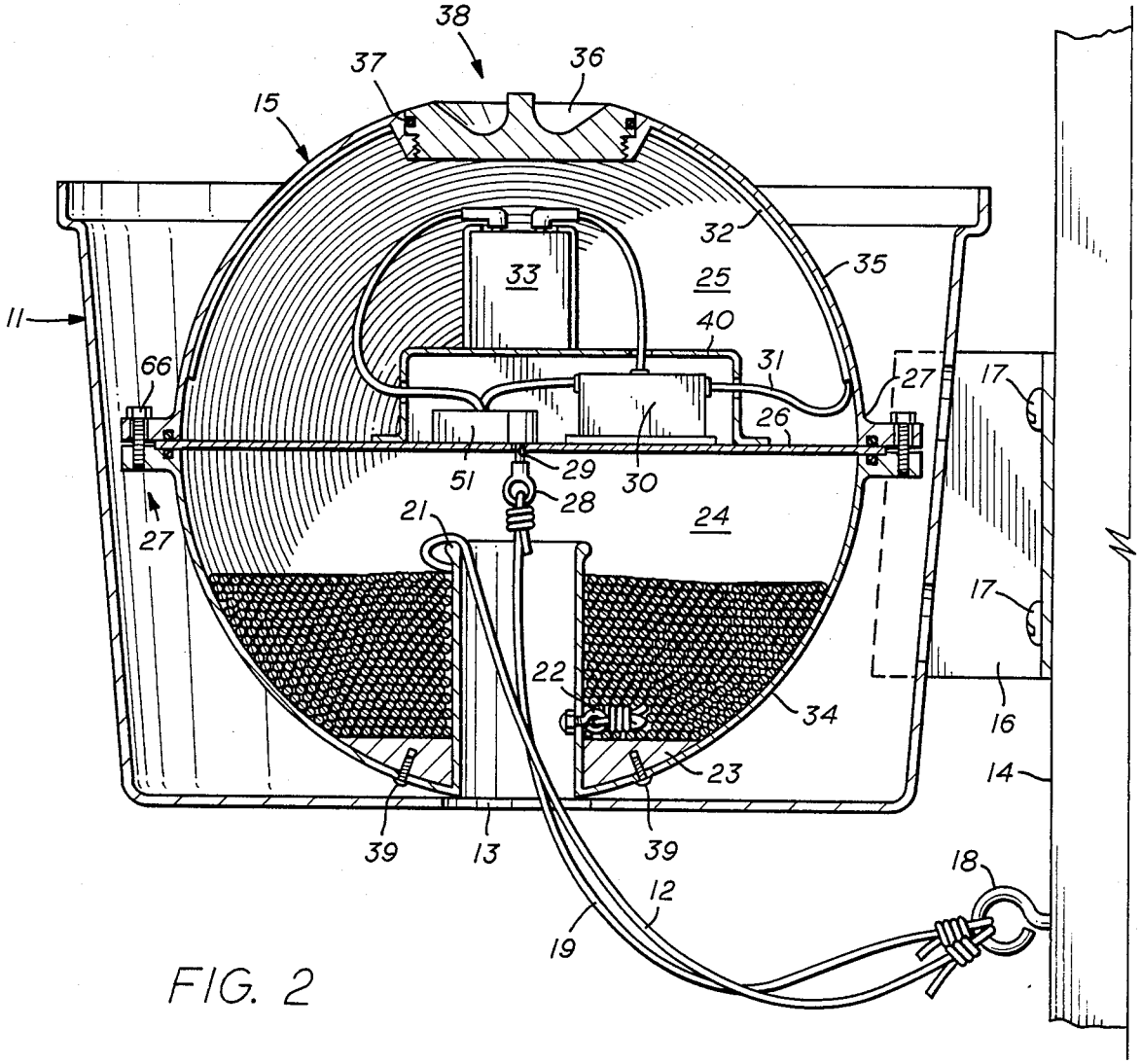
FIG. 2 is a lateral sectional view of the invention.

Referring to FIG. 2, the buoy 15 can be seen in its usual at rest position within the receptacle 11. The buoy 15 is seen to comprise, in its major separate physical components, an upper shell 35, a lower shell 34, and a center plate 26. The upper half 25 of the buoy 15 is, in the preferred embodiment, a hollow, hemispherical upper shell 35 containing or providing various components hereinafter described. The lower half 24 of the buoy 15 is, in the preferred embodiment, a hollow, hemispherical lower shell 34 containing or providing various components hereinafter described.

Figure 4:
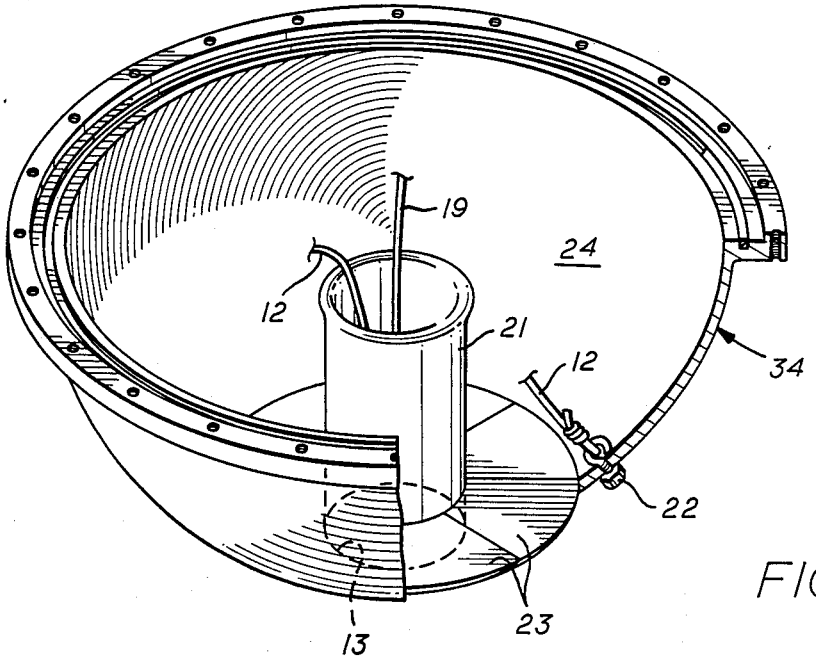
FIG. 4 is a perspective view, partly in section, of the bottom half of the buoy.

The lower shell 34 of the buoy 15 is shown in FIG. 4 of in the drawings as hemispherical with a cylindrical tube 21 extending through its surface. Within the lower shell 34, and in the lower regions thereof, is placed a ballast 23 which is attached to the lower shell 34 by fastener means 39 and which is intended to assist in maintaining a correct top-bottom orientation of the buoy when it is floating free of the receptacle 11. Also within the lower shell 34 is coiled the line 12 which connects the buoy 15 to the superstructure 14 of the vessel 20. The line 12 is coiled around the cylindrical tube 21 within the lower shell 34. The cylindrical tube 21 serves both as a guide to pay out the line 12 and as a means to keep water from rushing into the buoy 15 when it is afloat. Note that the draft of the buoy 15 may not be greater than the length of the cylindrical tube 21 and that the greatest draft is possible if the cylindrical tube 21 is oriented such that its long axis is perpendicular to the surface of the water when the buoy 15 is afloat. The line 12 may be connected by the fastener means 22 to the cylindrical tube 21 as shown in FIG. 2 or to any portion of the lower shell 34 as shown in FIG. 4.

Figure 3A:
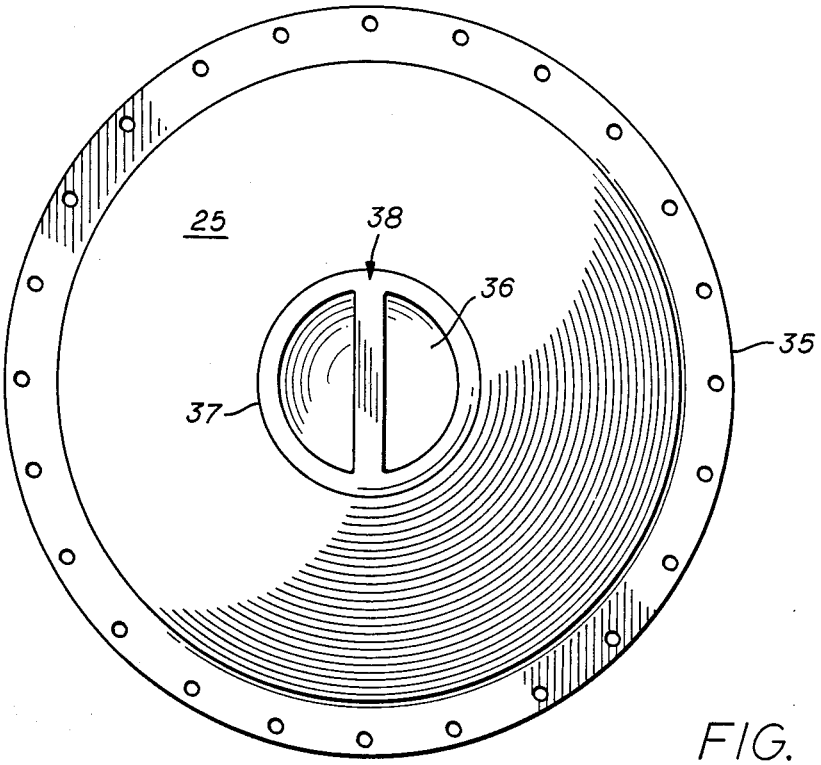
FIG. 3*a* is a downward vertical view of the exterior of the top half of the buoy.
Figure 3B:
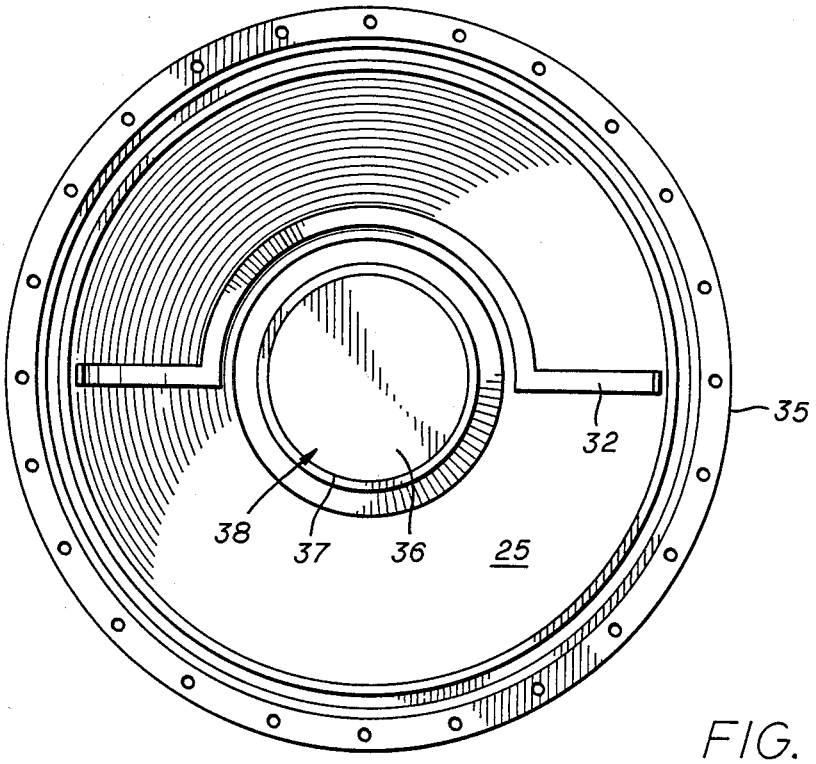
FIG. 3*b* is an upward vertical view of the interior of the top half of the buoy.

The upper shell 35 of the buoy 15 is depicted in the drawings as hemispherical with an access port through its surface. The access port is shown in FIG. 2, FIG. 3*a* and FIG. 3*b* as being covered by the access port cover 36. Said access port cover 36 provides a handle 38 and is in sealed connection 37 with the upper shell 35. The sealed connection 37 may be understood to be an O ring washer or seal if the access port cover 36 is threadably engaged with the upper shell 35. Additionally, the upper shell 35 has attached to its interior surface a radio antenna 32. Accordingly, it is expected that the upper shell 35 will be contructed of materials that are transparent to radio frequency transmissions. The means by which the radio antenna 32 is attached to the upper shell 35 are varied and may range from glue, to fasteners, to actual imbedding of the radio antenna 32 in the material of the upper shell 35.

FIG. 2 shows the arrangement of the radio transmitter 30, the power source 33, and the pull-key mechanism 51 on the center plate 26. The radio transmitter 30 and the pull-key mechanism 51 are contained within a housing 40 which also serves as a support for the power source 33. The housing 40 is attached to the center plate 26 and together with the center plate 26 completely envelopes the radio transmitter 30 and the pull-key mechanism 51, save only the pull-key shaft 41 which extends through the center plate 26. The housing 40 additionally is formed in such fashion as to provide lateral restraints on the movement of the power source 33 while providing physical support for the weight of the power source 33 and allowing easy vertical access to the power source 33 from above through the access port cover 36. As shown in FIG. 2 and FIG. 5*b*, the center plate 26 also provides an orifice 29 which allows the pull-key shaft 41 to extend through the center plate 26 and provides sealed fastener means 27 whereby the upper shell 35 is sealably fastened to the center plate 26 and to the lower shell 34, and the lower shell 34 is sealably fastened to the center plate 26 and to the upper shell 35.

Figure 5A:
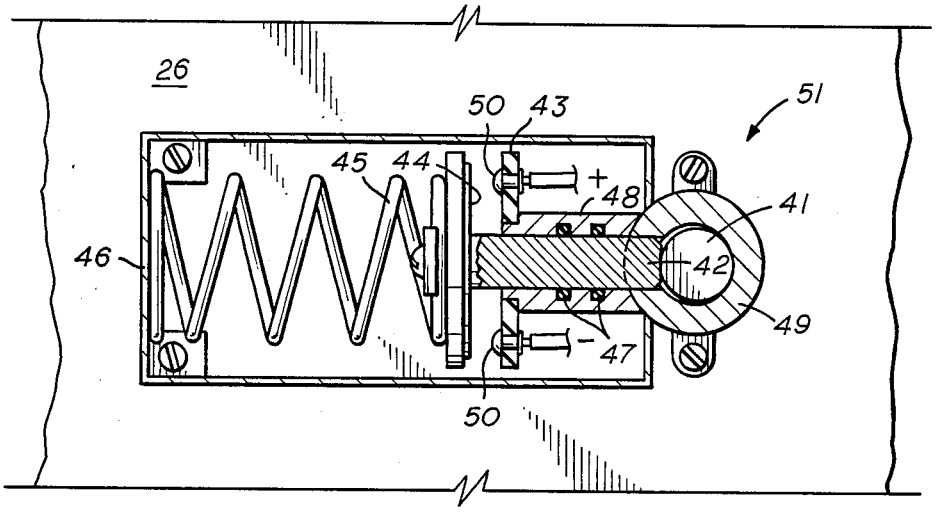
FIG. 5*a* is a horizontal elevation, partly in section, of the detail of the pull-key switch contained within the buoy.
Figure 5B:
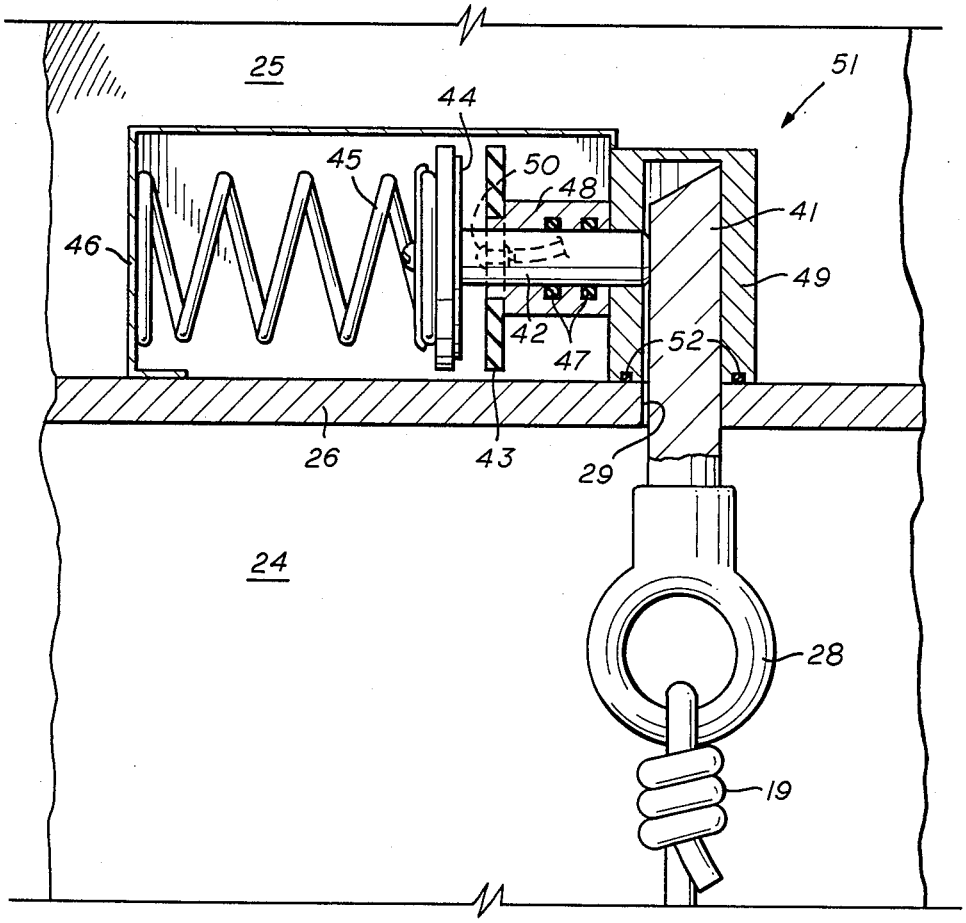
FIG. 5*b* is a vertical elevation, partly in section, of the detail of the pull-key switch contained within the buoy.

Detail of the pull-key mechanism 51 is shown in FIG. 5*a* and FIG. 5*b*. Said detail shows that the pull-key mechanism 51 is enclosed within a shaft housing 49 which has attached thereto a plunger housing 46. Together the shaft housing 49 and the plunger housing 46 form a watertight enclosure around the pull-key mechanism 51 which is in sealed connection 52 with the center plate 26 such that the pull-key shaft 41 protrudes through the orifice 29 in the center plate 26. The pull-key mechanism 51 is comprised of a shaft housing 49, a plunger housing 46, a spring 45, a plunger 42 having an end cap 44 which is conductive to electron flow, an annular seating plate 43 against which the end cap 44 rests when the spring 45 is allowed to extend from its normally compressed state within the plunger housing 46, a plunger bore 48 through which the plunger 42 slideably moves into the shaft housing 49 when the pull-key shaft 41 is withdrawn from the pull-key mechanism 51. O ring seals 47 are provided within the plunger bore 48 to slideably engage the plunger 42 and provide a watertight seal.

As shown in FIG. 5*a*, the annular seating plate 43 of the pull-key mechanism 51, which annular seating plate 43 is constructed of electron flow insulator material, provides, on its surface facing away from the plunger bore 48 to which it is attached, two electrical contacts 50 which comprise an open circuit until such time as the spring 45 is extended and pushes the plunger 42 into the plunger bore 48 sufficiently to bring the end cap 44 into contact with the annular seating plate 43 at which time a closed circuit is formed. The electrical contacts 50 are electrically connected such that one of the electrical contacts 50 is electrically connected to the positive output of the power source 33 and the other of the electrical contacts 50 is electrically connected to the positive power input of the radio transmitter 30.

The pull-key mechanism 51 is thus able to turn on the radio transmitter 30 when the pull-key shaft 41 is withdrawn allowing the plunger 42 to extend into the shaft housing 49. As shown in FIG. 2, the radio transmitter 30 output has an electrical connection 31 to the radio antenna 32 whereby when the radio transmitter 30 is activated a radio frequency signal is transmitted from the radio antenna 32.

Figure 6:
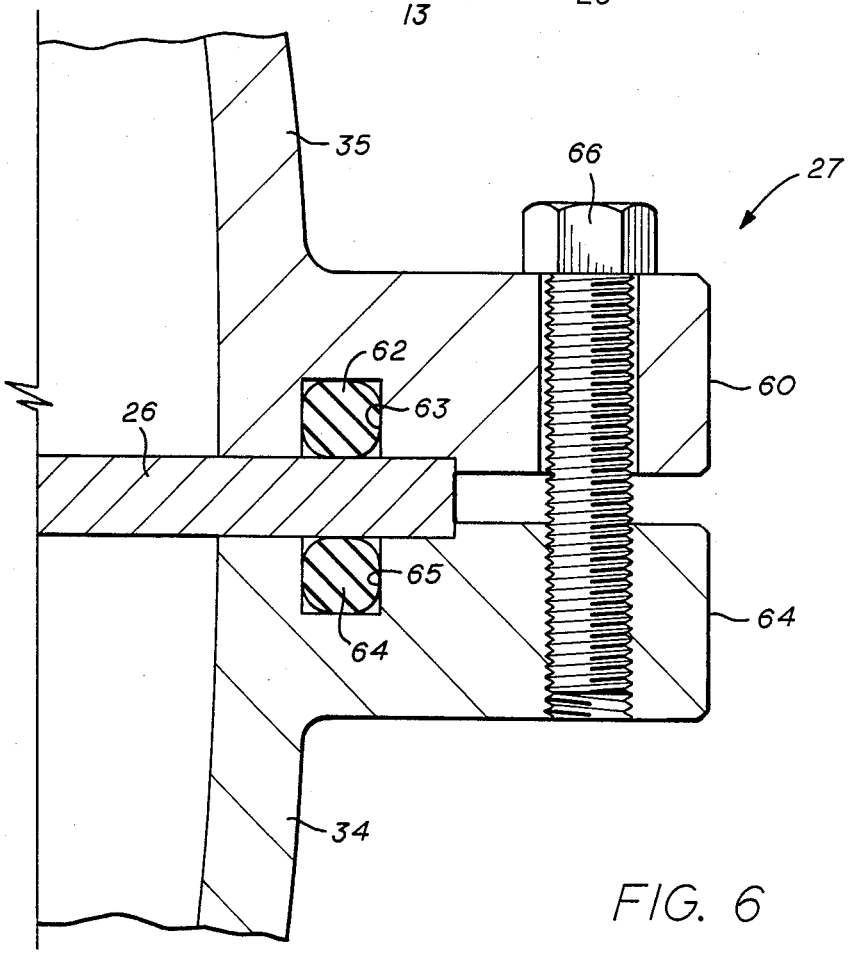
FIG. 6 is a sectional vertical elevation of the detail of the connection and seal of the upper part of the buoy to the lower part of the buoy.

In FIG. 6 the connection of the upper shell 35 to the center plate 26 and to the lower shell 34 is shown in detail. While the connection made by the sealed fastener means 27 may comprise any watertight fitting, the preferred embodiment makes the connection as shown in FIG. 6 by providing a flange 60 at the circumference of the upper shell 35 and a flange 61 at the circumference of the lower shell. Each of said flanges 60 and 61 is drilled and tapped with threads to receive a screw 66 which, when tightened, pulls the upper shell 35 and the lower shell 34 together. The flange 60 provides a groove 62 suitable to receive the O ring seal 63 between the upper shell 35 and the center plate 26. The flange 61 provides a groove 65 suitable to receive the O ring seal 64 between the lower shell 34 and the center plate 26. When the screw 66 is tightened, the upper shell 35 and the lower shell 34 are pulled together and squeezeably engage the center plate 26 compressing said O ring seals 63 and 64 forming a watertight seal between the upper shell 35 and the center plate 26 and between the lower shell 34 and the center plate 26.

In operation, the buoy 15 floats free of the receptacle 11 when the vessel 20 sinks and the pull-key chord 19 pulls the pull-key shaft 41 free of the pull-key mechanism 51 which then switches on electricity from the power source 33 to the radio transmitter 30. As the buoy 15 floats free of the vessel 20, the line 12 is paid out through the cylindrical tube 21 thus avoiding entanglements of the line 12 and allowing the buoy 15 to float on the surface of the water above the vessel 20 providing a visual indicator of the location of the vessel 20 at the same time that the radio transmitter 30 is transmitting a radio signal for location of the vessel 20 by radio direction finding techniques.

What is claimed is:

1. A sunken vessel locator buoy suitable for being carried in a receptacle attached to the superstructure of a vessel in such manner that said buoy will float free of said vessel in the event of said vessel's sinking, wherein said buoy is connected to the superstructure of said vessel by a line stored inside said buoy and paid out from said buoy as said vessel sinks beneath the surface of the water, and wherein said buoy is generally spherical in shape and is constructed of an upper hemispherically shaped shell, a lower hemispherically shaped shell, and a circular center plate to which the said upper and lower hemispherically shaped shells are attached in water-tight connection, and wherein said upper hemispherically shaped shell is constructed of materials which are transparent to radio frequency transmissions, and wherein said upper hemispherically shaped shell is in water-tight connection with said circular center plate forming an interior water-tight compartment for the enclosure of a power supply, a radio transmitter, a radio antenna, and a pull-key switch mechanism, and wherein said pull-key switch mechanism is activated by means of the retraction of a pull-key shaft which extends through an orifice in the center plate into the lower hemispherically shaped shell of said buoy, and wherein said pull-key shaft is connected by a second line to the superstructure of said vessel, whereby when said second line is pulled taut as said vessel sinks, said pull-key shaft is retracted from said pull-key switch which makes electrical connection between said power supply and said radio transmitter, whereby said radio transmitter is activated and transmits, via said radio antenna, a radio frequency signal which may be homed - in on to locate said buoy and said sunken vessel located beneath the water.

2. The device of claim 1 wherein the lower hemispherically shaped shell of said buoy provides a ballast.

3. The device of claim 1 wherein the upper hemispherically shaped shell of said buoy provides a porthole for access to the power supply.

4. The device of claim 1 wherein the lower hemispherically shaped shell of said buoy provides a cylindrical tube from said buoy's exterior to said buoy's interior through which cylindrical tube said line connecting said buoy to said vessel is paid out.

* * * * *